US006328827B1

(12) United States Patent
Bouzidi et al.

(10) Patent No.: US 6,328,827 B1
(45) Date of Patent: Dec. 11, 2001

(54) METHOD OF MANUFACTURING SHEETS MADE OF ALLOY 718 FOR THE SUPERPLASTIC FORMING OF PARTS THEREFROM

(75) Inventors: Mohamed Bouzidi, Choisy le Roi; Philippe Caburet, Bonnemarie; Pierre Clement, Soignolles en Brie; André Claude Félix Collot, Mennecy; Jean-Lou Lebrun, Palaiseau; Benoit Marty, Vieux Rouen/Bresles, all of (FR)

(73) Assignee: Societe Nationale d'Etude et de Construction de Moteurs d'Aviation "Snecma", Paris (FR)

( * ) Notice: Subject to any disclaimer, the term of this patent is extended or adjusted under 35 U.S.C. 154(b) by 1076 days.

(21) Appl. No.: 08/498,482

(22) Filed: Jul. 5, 1995

(30) Foreign Application Priority Data

Jul. 13, 1994 (FR) ..... 94 08703

(51) Int. Cl.[7] ..... C22F 1/10

(52) U.S. Cl. ..... 148/556; 148/675; 148/677; 148/564

(58) Field of Search ..... 148/675, 677, 148/564, 556

(56) References Cited

U.S. PATENT DOCUMENTS

| | | | | |
|---|---|---|---|---|
| 3,519,419 | | 7/1970 | Gibson et al. . | |
| 3,519,503 | | 7/1970 | Moore et al. . | |
| 3,642,543 | * | 2/1972 | Owczarski et al. | 148/677 |
| 3,660,177 | | 5/1972 | Brown et al. . | |
| 3,676,225 | * | 7/1972 | Owczarski et al. | 148/677 |
| 4,518,442 | * | 5/1985 | Chin | 148/404 |
| 4,793,868 | * | 12/1988 | Chang | 148/677 |
| 4,798,632 | * | 1/1989 | Yonezawa et al. | 148/677 |
| 4,919,323 | | 4/1990 | Mahoney et al. . | |
| 4,935,069 | | 6/1990 | Kuboki et al. . | |
| 5,417,782 | * | 5/1995 | Rongvaux | 148/675 |

FOREIGN PATENT DOCUMENTS

| | | | | |
|---|---|---|---|---|
| 674724 | * | 7/1952 | (GB) | 148/677 |
| 63274747 | * | 11/1988 | (JP) | 148/677 |

OTHER PUBLICATIONS

Smith, Gaylord D & H. Lee Flower, "Superplastic Forming of Alloy 718" in Advanced Materials & Process 4/94 pp. 32–34.*

Ceschini, L; G. P. Cammarota, G. L. Garagnaniand A. Afrikantov, "Variazioi MicrostrulturaliNella Lega IN–718 Indotte da Trattamenti Termici E Meccanici" in LaMetallurgica Italiana, vol. 86, n6–7/1994 pp. 355–362.*

CA: 123: 119741, Sep. 4, 1995.*

CA: 122: 167420 Apr. 3, 1995.*

CA: 121: 306012 Dec. 26, 1994.*

CA 121: 162021 Oct. 3, 1994.*

Traitements Thermomecaniques de L'Alliage NC 19 FE NB (INCONEL 718), Memories et Etudes Scient–Fiques Revue de Mantallurgie, vol. 83, No. 11, Nov. 1986, pp. 561–569.

Effect of 65 1–Phase Content on Preparation Schedule for Structure and Superplasticity of High–Temperature Nickel Alloys, Metal Science and Heat Treatment, vol. 31, No. 7/8, 1989, pp. 526–532.

* cited by examiner

*Primary Examiner*—Roy King
*Assistant Examiner*—Nicole Coy
(74) *Attorney, Agent, or Firm*—Oblon, Spivak, McClelland, Maier & Neustadt, P.C.

(57) ABSTRACT

In order to obtain sheets made of a nickel-based superalloy of type 718 having properties of superplasticity, the sheets are manufactured with a final cycle comprising the steps of:

a) solution treatment at 1060° C. for 15 minutes;

b) precipitation at 730° C. to 800° C. for 1 to 2 hours;

c) cold rolling at a ratio greater than 60%, and d) recrystallization at 900° C. for 30 minutes.

Superplastic deformation of such sheets is carried out at about 970±10° C. and under pressures inducing stresses between 45 and 60 MPa.

7 Claims, 1 Drawing Sheet

METHOD OF MANUFACTURING SHEETS MADE OF ALLOY 718 FOR THE SUPERPLASTIC FORMING OF PARTS THEREFROM

BACKGROUND OF THE INVENTION

1. Field of the Invention

The present invention relates to a method of manufacturing sheets having superplastic properties from a nickel-based superalloy known by the name of "alloy 718", and also to a method of forming parts by superplastic deformation of such sheets.

2. Summary of the Prior Art

Numerous applications of superplastic forming processes have been developed, particularly in aeronautics, for producing parts from titanium and aluminium based sheets. Some sandwich-type structures in particular are obtained by combining the processes of superplastic forming and diffusion welding. These applications have demonstrated the advantages, in terms of quality, cost, productivity and industrial expertise, of using a superplastic forming process for making parts from sheets.

In addition, the designer's preferred choice of material for numerous parts of casing or fixed structure type for aircraft engines, turbojets or turbo-machines is a nickel-based superalloy known by the name of "alloy 718", and a typical composition of which is, by weight, 19% Cr, 18% Fe, 5% Nb+Ta, 3% Mo, 1% Ti, 0.5% Al, and mainly Ni as the remainder.

Currently, however, sheets of alloy 718 do not possess superplastic properties, and mechanical elongation characteristics as low as A%=12 are normally allowed for these sheets.

Consequently, the invention seeks to determine particular manufacturing and forming conditions which will enable parts to be made from sheets of alloy 718 by superplastic forming.

SUMMARY OF THE INVENTION

According to a first aspect of the invention there is provided a method of manufacturing a sheet from a nickel-based superalloy known by the name of "alloy 718" and having a typical composition comprising, by weight, 19% Cr, 18% Fe, 5% Nb+Ta, 3% Mo, 1% Ti, 0.5% Al, and mainly Ni as the remainder, comprising a preliminary cycle including at least the steps of casting and hot rolling said sheet, and a final cycle comprising the following steps in order to impart properties of superplasticity to said sheet:

a) solution heat treatment at a temperature of substantially 1060° C. for substantially 15 minutes;

b) precipitation heat treatment at a temperature between 730° C. and 800° C. for a period of from one to two hours;

c) cold rolling at a rolling ratio greater than 60%; and, d) recrystallization heat treatment at a temperature of substantially 900° C. for substantially 30 minutes.

According to a second aspect of the invention parts are formed from sheets of alloy 718 manufactured in accordance with the invention by superplastic deformation carried out at a temperature below 985° C., preferably at a temperature of 970°±10° C., and by applying pressures calculated to obtain stresses within the material of between 45 and 60 MPa.

Further preferred features and advantages of the invention will become apparent from the following more detailed description of embodiments of the invention, given by way of example, with reference to the attached drawings.

DETAILED DESCRIPTION OF THE INVENTION AND EMBODIMENTS THEREOF

The material used in carrying out the invention is a nickel-based superalloy currently known by the name of alloy 718. A typical composition of alloy 718 has been given earlier, but the composition may vary within the following limits, defined as percentages by weight:

Cr 17 to 21; Fe 16.5 to 20.5; Nb+Ta 4.75 to 5.5;

Mo 2.8 to 3.3; Ti 0.75 to 1.15; Al 0.3 to 0.7;

C 0.02 to 0.08; Mn below 0.35; Cu below 0.3; Co below 1;

B below 0.006; P below 0.015; S below 0.015;

Si below 0.35; Bi below 0.0001; Ag below 0.0005;

Pb below 0.001; and Ni as the remainder.

A preliminary cycle in manufacturing sheets of alloy 718 is known which includes in particular the standard steps of casting after melting at about 1450° C., a hot rolling operation followed by a solution heat treatment at a temperature of 1060° for fifteen minutes, then a cold rolling operation. This preliminary cycle may be completed by a further heat treatment, for example by holding the sheet for fifteen minutes at a temperature of 955° C.

Sheets having gone through the manufacturing cycle just described correspond to a standard supply condition for uses which do not require the alloy 718 material to exhibit properties of superplasticity during the making of parts from the sheets. The mechanical properties determined from a specimen taken along the length of a sheet made in the manner described above are:

Re: 410 MPa

Re 0.2: 476 MPa

Rm: over 943 MPa

HV hardness: 266

After a use heat treatment involving maintenance at 720° C. for eight hours, followed by cooling in a furnace at a rate of 50° C. per hour down to 620° C., maintenance at 620° C. for eight hours, and then air cooling, the following mechanical characteristics were measured:

Re 0.2: 1276 MPa

Rm: 1455 MPa

A%: 17

HRB hardness: 99

Figure 1:
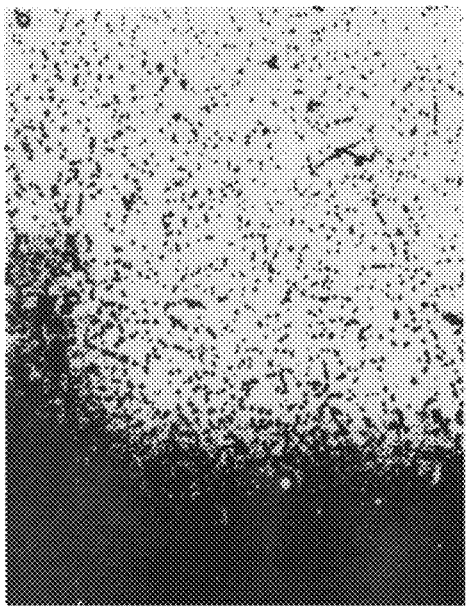
FIG. 1 shows a microphotograph exhibiting the metallurgical structure of alloy 718 in sheet form manufactured in a known manner and complying with present standards.

The metallurgical structure obtained is shown in the micrograph reproduced in FIG. 1. Grains of 10 to 30 $\mu$m are observed which originate from recrystallization during the heat treatment which was carried out at 955° C. for fifteen minutes.

Tests have been carried out in order to determine modifications in the cycle of manufacturing sheets of alloy 718, which result in properties of superplasticity being imparted to the sheets so as to make them suitable for use in the production of parts by a superplastic forming process.

Figure 2:
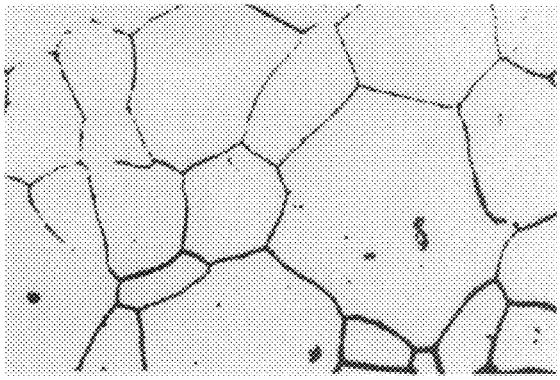
FIG. 2 shows a microphotograph exhibiting the metallurgical structure of a sheet of alloy 718 after heat treatment at 1000° C.
Figure 3:
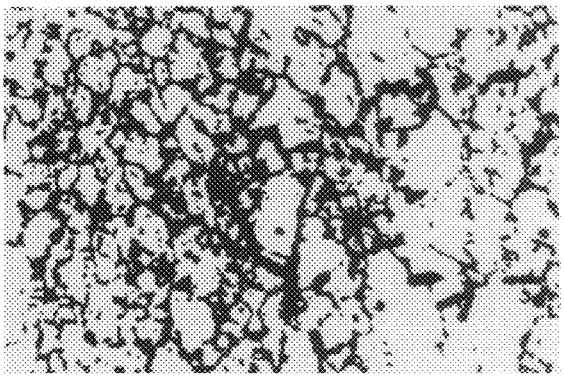
FIG. 3 shows a microphotograph exhibiting the metallurgical structure of a sheet of alloy 718 after heat treatment at 950° C.
Figure 4:
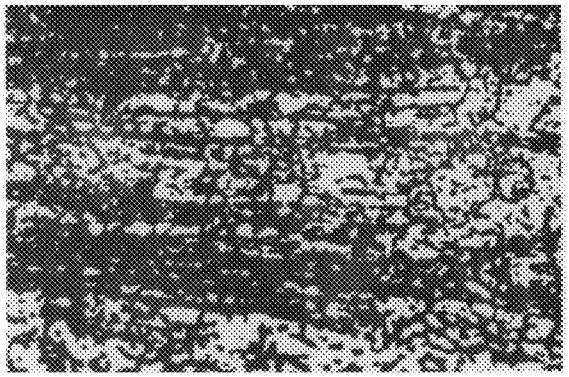
FIG. 4 shows a microphotograph exhibiting the metallurgical structure of a sheet of alloy 718 after heat treatment at 900° C.; and, FIG. 5 shows a microphotograph exhibiting the metallurgical structure of a sheet of alloy 718 manufactured by the method in accordance with the invention.

A first series of tests enabled the influence of the temperature and duration of a heat treatment on the superplasticity properties of an alloy 718 to be determined. Various temperatures were tested: 900° C., 950° C., 1000° C., and also various treatment times: 6 minutes, 15 minutes, 30 minutes, 1 hour, 2 hours, 4 hours. After the treatments at 1000° C., examination of the metallurgical structure obtained showed the total absence of delta phase and a very clear recrystallization, as evidenced by the micrograph reproduced in FIG. 2. At 950° C. a delta phase precipitation appears as may be seen in the micrograph of FIG. 3, but the recrystallization phenomenon remains dominant. The precipitation shows irregularities and the grain size dispersion is quite substantial. At 900° C., it is observed that with between 15 minutes and 1 hour of treatment work-hardened cells convert into new grains, whereas with more than one hour of treatment, the cell conversion having ended, the delta phase precipitation continues until saturation. The result of the heat treatment carried out, the optimum conditions of which are consequently situated at the temperature of 900° C. and a length of thirty minutes, is to inhibit the growth of the grain due to the dense and homogenous precipitation of the delta phase. The structure obtained is thus a fine structure, the size of the grains being below 10 $\mu$m, with precipitations at the grain joints, as may be seen in the micrograph of FIG. 4.

The determination of the conditions of heat treatment thus arrived at on the basis of micrographic studies was confirmed by tensile tests in the hot state. A maximum elongation characteristic was obtained after the heat treatment at 900° C. for a time of the order of thirty minutes. This result is related to the structure obtained corresponding to a precipitation sufficient to ensure a small grain without leading to excessive hardening. Interesting superplasticity properties may, consequently, by envisaged for sheets of alloy 718 after the said thermal treatment at 900° C. for thirty minutes, making it possible to obtain sufficient delta phase nucleation without generating too substantial a recrystallization.

Another factor which influences the superplasticity of sheets of alloy 718 was established from tests as the work-hardening rate resulting from cold rolling operations.

The rolling ratio may be regarded as an equivalent datum. The results obtained when applying a rolling ratio of 60% have shown that this ratio is not adequate, as the elongation values obtained are insufficient to ensure a superplasticity capacity and a sufficient aptitude to the corresponding forming of the sheets. On the other hand, the application of a 77% rolling ratio has shown that superplasticity properties of sheets of alloy 718 are obtained in this case.

It will be recalled that within a material of the alloy 718 type, several phases coexist, in particular:

an austenitic matrix, a gamma-prime phase of cubic $Ni_3$ Al/Ti type with centered faces, a delta phase of orthorhombic $Ni_3Nb$ type, the role of which has been described above in connection with the determination of the heat treatment terminating the final manufacturing cycle of the invention and making the sheets of alloy 718 suitable for superplastic forming, and a gamma double-dash phase of quadratic or tetragonal $Ni_3Nb$ type.

The diagrams for the appearance of these phases for alloy 718 are well known.

From the metallurgical point of view, after a gamma-double-dash phase precipitation, the invention involves creating a network of dislocations around the precipitates obtained and, by shearing in the course of a cold-rolling operation, bringing about the manifestation of delta phase nuclei, the growth of which is ensured by the final thermal treatment so as to obtain, as noted earlier, a fine and homogeneous structure with appropriate precipitation, ensuring for the material the required characteristics of superplastic elongation.

In order to define the heat treatment conditions for the precipitation of the gamma-double-dash phase, and so as to ensure a coherence and repeatability of the results, it is necessary, after the preliminary cycle in the manufacture of the sheets of alloy 718, to carry out first of all a solution heat treatment. The conditions of this treatment are known per se for alloy 718 and comprise holding the sheets at a temperature of 1060° C. for 15 minutes.

Tests have been carried out applying the following precipitation heat treatment conditions before the cold-rolling operation:

either holding the sheets for two hours at a temperature of 730° C., or holding them for one hour at a temperature of 800° C.

Then, the duration of the heat treatment was varied by:

either holding sheets for one hour at a temperature of 730°, or holding sheets for thirty minutes at a temperature of 800° C.

Figure 5:
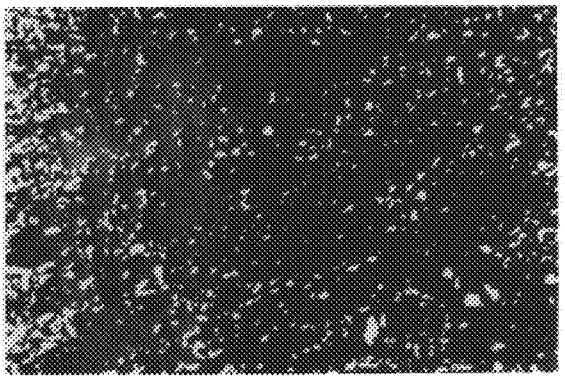

A micrographic analysis of the results obtained shows that a fine and even structure is obtained by associating a heat treatment at a temperature between 730° C. and 800° C. for a period of between one and two hours, with cold-rolling with a rolling ratio in excess of 60%. A 77% rolling ratio leads to good results. The micrograph of FIG. 5 shows the fine metallurgical structure obtained after the recrystallization heat treatment at 900° C. for 30 minutes.

A complementary study was conducted on the basis of hardness readings, this mechanical characteristic being regarded as a good indicator of the potential superplastic properties of the material studied. The results also confirm the effect of the selected heat treatment and cold rolling parameters which have been described above.

Tensile tests carried out in the hot state on specimens having gone through the manufacturing cycles just described have revealed that breaking elongations of 300% may be obtained, at an optimum speed of $\epsilon=10^{-3}$ $s^{-1}$ and with a coefficient m between 0.5 and 0.55, m being the coefficient in the law relating the stress $\sigma$ and the speed $\epsilon$ in the tensile test: $\sigma=K\epsilon^m$.

The results obtained by the method of manufacturing sheets of alloy 718 in accordance with the invention were confirmed by a number of superplastic forming tests for which certain parameters have been determined. Thus, after having established, as has been described earlier, the conditions of the final heat treatment as 900° C. for 30 minutes in the final manufacturing cycle of the sheets of alloy 718, the stability of the metallurgical structure obtained was tested.

A heat treatment representative of the static phase of the temperature rise in the course of a superplastic forming operation was thus applied to sheet specimens. Treatment at 985° C. for four hours showed that this temperature constitutes a limit for retaining a stable structure comprising the delta phase precipitates at the grain joints blocking recrystallization. Above 985° C. there is observed a destruction of the precipitates and of the structure of the material, making it unsuitable for superplastic forming. A forming temperature situated at about 970° C. represents an optimum solution. An examination of the metallurgical structure after superplastic forming reveals that in the absence of recrystallization the structure retains its fineness and its eveness, the grain size not exceeding 5 $\mu$m in the cases observed. Above a given deformation ratio the recrystallization phenomenon manifests itself for high deformation rates.

Superplastic forming operations for the production of parts from sheets of alloy 718 made in accordance with the invention may be carried out under industrial conditions, applying pressures leading to stresses within the material of between 45 and 60 MPa. Elongations of the order of 500% can thus be obtained in less than fifteen minutes and the deformation rates are substantial, ranging, for example, from $5\times10^{-4}$ $s^{-1}$ to $10^{-2}$ $s^{-1}$.

The cavitation ratios observed during superplastic forming remain low even for high elongations. An improvement is obtained by applying a counter-pressure, and a value several times that of the differential pressure P required for inflation may be applied. A reduction or a suppression of cavitation phenomena is also obtained by reducing the presence of precipitation of titanium carbonitrides in the metallurgical structure of the alloy 718 used. Cavitation may also be reduced or suppressed through a hot isostatic compaction treatment under known conditions, such as a temperature of 950° C. to 970° C. and a pressure of $10^8$Pa.

We claim:

1. A method of manufacturing a sheet of nickel based alloy 718, comprising:

casting said alloy;

solution heat treating said alloy;

precipitation heat treating said alloy;

cold rolling said alloy at a rolling ratio of greater than 60%; and recrystallization heat treating said alloy thereby forming an alloy with a grain size of at most 10 $\mu$m;

wherein said precipitation heat treating is conducted at a temperature of 730–800° C. for 1–2 hours, and said alloy 718 consists essentially of, in percent by weight:

Cr 17 to 21; Fe 16.5 to 20.5; Nb+Ta 4.75 to 5.5;
Mo 2.8 to 3.3; Ti 0.75 to 1.15; Al 0.3 to 0.7;
C 0.02 to 0.08; Mn below 0.35; Cu below 0.3; Co below 1;
B below 0.006; P below 0.015; S below 0.015;
Si below 0.35; Bi below 0.0001; Ag below 0.0005;
Pb below 0.001; and Ni as the remainder.

2. A method according to claim 1 wherein said rolling ratio is 77%.

3. The method of claim 1, wherein said solution heat treating is carried out at 1,060° C. for 15 minutes.

4. The method of claim 1, wherein said recrystallization heat treating is carried out at 900° C. for 30 minutes.

5. A method of forming a part by superplastic deformation, comprising:

manufacturing a sheet of nickel-based alloy 718 by the method of claim 1; followed by superplastically deforming said sheet at a temperature below 985° C.

6. The method of claim 5, wherein said superplastic deforming is carried out at a temperature of 960–980° C.

7. The method of claim 5, wherein said superplastic deforming is carried out by applying pressures calculated to obtain stresses between 45 and 60 MPA within said sheet.

* * * * *